US008118039B2

(12) United States Patent
Chang

(10) Patent No.: US 8,118,039 B2
(45) Date of Patent: Feb. 21, 2012

(54) ARTIFICIAL NAIL SETS AND MANUFACTURING METHODS THEREOF

(76) Inventor: Sung Yong Chang, Roslyn Heights, NY (US)

( * ) Notice: Subject to any disclaimer, the term of this patent is extended or adjusted under 35 U.S.C. 154(b) by 29 days.

(21) Appl. No.: 12/486,485

(22) Filed: Jun. 17, 2009

(65) Prior Publication Data

US 2010/0242979 A1 Sep. 30, 2010

(30) Foreign Application Priority Data

Mar. 27, 2009 (KR) ..... 10-2009-0026208

(51) Int. Cl.
*A45D 29/00* (2006.01)
*A45D 7/00* (2006.01)

(52) U.S. Cl. ..... 132/285

(58) Field of Classification Search ..... 132/73, 132/73.5, 75.3, 76.2, 285, 320, 200; 2/21; 424/61

See application file for complete search history.

(56) References Cited

U.S. PATENT DOCUMENTS

| | | | | | |
|---|---|---|---|---|---|
| 1,135,382 | A * | 4/1915 | Kindred | 2/21 |
| 2,438,901 | A * | 4/1948 | Coxe | 2/21 |
| 2,799,282 | A * | 7/1957 | Slack | 132/285 |
| 4,445,234 | A * | 5/1984 | Ogunro | 623/54 |
| 4,559,055 | A * | 12/1985 | Ogunro | 606/1 |
| 4,605,024 | A * | 8/1986 | Tremblay | 132/320 |
| 4,908,881 | A * | 3/1990 | Field | 2/21 |
| 5,005,595 | A * | 4/1991 | Aylott | 132/73 |
| 5,036,589 | A * | 8/1991 | Heinrich | 30/298 |
| 5,413,123 | A * | 5/1995 | Aylott et al. | 132/73 |
| 5,704,375 | A * | 1/1998 | Wood | 132/73 |
| 5,782,248 | A * | 7/1998 | Chang | 132/200 |
| 5,924,428 | A * | 7/1999 | Song | 132/285 |
| 6,293,283 | B1 * | 9/2001 | Washington | 132/73 |
| 7,338,523 | B2 * | 3/2008 | Brodkin | 623/11.11 |
| 2001/0037814 | A1 * | 11/2001 | Meinschewnk | 132/73 |
| 2004/0205943 | A1 * | 10/2004 | Takabayashi et al. | 24/504 |
| 2004/0216757 | A1 * | 11/2004 | Chang | 132/73 |
| 2005/0268931 | A1 * | 12/2005 | Chang | 132/200 |
| 2010/0005563 | A1 * | 1/2010 | Park | 2/160 |
| 2010/0066710 | A1 * | 3/2010 | Koibuchi | 345/205 |

FOREIGN PATENT DOCUMENTS

| | | | |
|---|---|---|---|
| JP | 4316003 | * | 8/2009 |
| WO | WO 2008111759 A1 | * | 9/2008 |

* cited by examiner

*Primary Examiner* — Todd Manahan
*Assistant Examiner* — Tatiana Nobrega
(74) *Attorney, Agent, or Firm* — Christie, Parker & Hale, LLP

(57) ABSTRACT

Artificial nail sets are provided. In an embodiment, the artificial nail set includes an artificial nail and an auxiliary member surrounding the outer surface of the artificial nail. The artificial nail has a connecting part formed at one side thereof and the auxiliary member has a coupling portion formed at one side thereof. The auxiliary member is not adherent to the artificial nail. The connecting part of the artificial nail is coupled to the coupling portion of the auxiliary member. In an alternative embodiment, the artificial nail may be directly coupled to the auxiliary member. Due to this coupling, the auxiliary member surrounds the outer surface of the artificial nail. Further provided are methods for manufacturing the artificial nail sets.

6 Claims, 4 Drawing Sheets

ARTIFICIAL NAIL SETS AND MANUFACTURING METHODS THEREOF

CROSS-REFERENCE TO RELATED APPLICATIONS

This application claims priority to and the benefit of Korean Patent Application No. 10-2009-0026208, filed on Mar. 27, 2009, in the Korean Intellectual Property Office, the entire content of which is incorporated herein by reference.

BACKGROUND OF THE INVENTION

1. Field of the Invention

The present invention relates to artificial nail sets adapted to attach artificial nails to natural nails. More specifically, the present invention relates to artificial nail sets that protect artificial nails susceptible to damage even by a weak shock, allow artificial nails to be easily attached to natural nails while preventing the lateral sides of artificial nails from being detached from natural nails, use an auxiliary member made of a material not adherent to artificial nails and glue, and have a circular arc shape. The present invention also relates to methods for manufacturing the artificial nail sets.

2. Description of the Related Art

Two nail care methods have been widely used for aesthetic purposes. The first method is to paint patterns or colors on natural nails using manicure or apply manicure to natural nails. The second method is to attach artificial nails to natural nails.

Artificial nails are generally used to improve the aesthetic appearance of fingers and/or toes and to replace lost or damaged natural nails. Typically, artificial nails are used to protect weak and fragile natural nails from damage and to obtain desired length and/or shape of natural nails.

With the recent development of beauty industry, artificial nails have drawn a great deal of attention and interest. Healthy and neat nails are recognized as essential aesthetic elements to make women more feminine and beautiful.

Advances in modern technology have made it possible to produce much smaller artificial nails in thickness. In actuality, thin artificial nails play a role in protecting natural nails from damage without causing inconvenience to wearers.

Thin artificial nails manufactured through several processes are likely to be deformed (e.g., folded or distorted) by a weak shock during subsequent packaging and transport, as illustrated in FIG. 1. In severe cases, thin artificial nails may be damaged, such as broken or scratched.

Conventional artificial nails are directly attached to user's natural nails for themselves or with the help of professional beauty artists without using any device. However, fingerprints and other impurities may be left on artificial nails, causing dirty or aesthetically unpleasant appearance. Further, as illustrated in FIG. 2, after a thin artificial nail 120 is attached to a natural nail, the lateral sides of the artificial nail 120 are detached from the natural nail, which leads to shortened service life and poor appearance of the artificial nail.

SUMMARY OF THE INVENTION

The present invention has been made in an effort to solve the above problems, and it is an object of the present invention to provide artificial nail sets that can be used to easily attach thin artificial nails to user's natural nails and prevent the lateral sides of artificial nails from being detached from user's natural nails while maintaining the original shape of the artificial nails susceptible to embrittlement even by a weak shock.

It is another object of the present invention to provide methods for manufacturing the artificial nail sets.

According to an aspect of the present invention, there is provided an artificial nail set which includes an artificial nail having a connecting part formed at one side thereof and an auxiliary member having a coupling portion formed at one side thereof and surrounding the outer surface of the artificial nail wherein the auxiliary member is not adherent to the artificial nail and the connecting part of the artificial nail is coupled to the coupling portion of the auxiliary member.

According to another aspect of the present invention, there is provided an artificial nail set which includes an artificial nail having a protrusion formed on the outer surface thereof and an auxiliary member having an insertion recess formed on the inner surface thereof and surrounding the outer surface of the artificial nail wherein the auxiliary member is not adherent to the artificial nail and the protrusion of the artificial nail is fitted into the insertion recess of the auxiliary member.

According to another aspect of the present invention, there is provided a method for manufacturing an artificial nail set, the method including: producing an auxiliary member having a coupling portion and an artificial nail having a connecting part separately by injection molding; and coupling the connecting part of the artificial nail to the coupling portion of the auxiliary member such that the auxiliary member surrounds the outer surface of the artificial nail.

According to yet another aspect of the present invention, there is provided a method for manufacturing an artificial nail set, the method including producing an artificial nail having a connecting part and an auxiliary member having a coupling portion simultaneously by injection molding such that the auxiliary member surrounds the outer surface of the artificial nail.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE INVENTION

Exemplary embodiments of the present invention will now be described in detail with reference to the accompanying drawings.

The same constitutions of the present invention as the prior art will now be explained with reference to the prior art, and further detailed explanation thereof is omitted herein.

Figure 1:
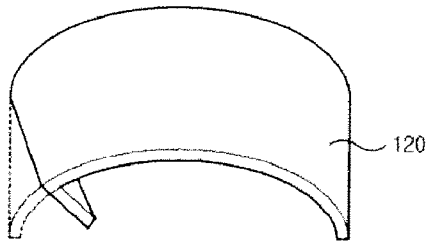
FIG. 1 is a perspective view of an artificial nail after transport without using any auxiliary member.
Figure 2:
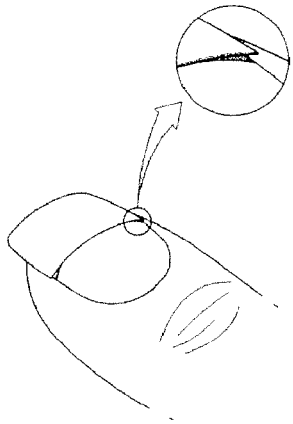
FIG. 2 is a perspective view of an artificial nail after being attached to a user's nail without using any auxiliary member.
Figure 3:
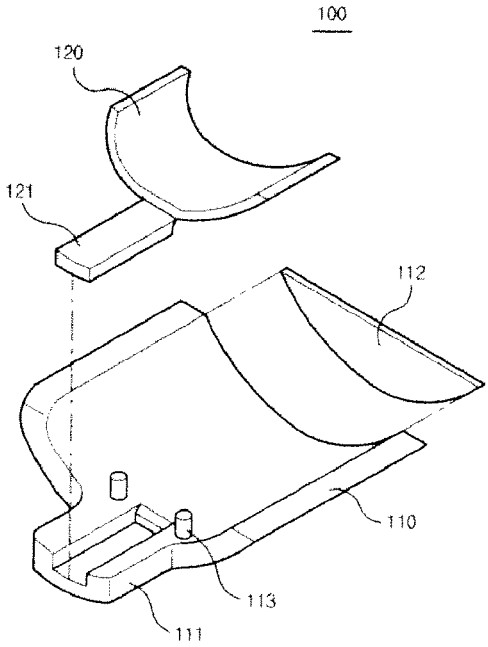
FIG. 3 is an exploded perspective view of an artificial nail set according to an exemplary embodiment of the present invention.
Figure 4:
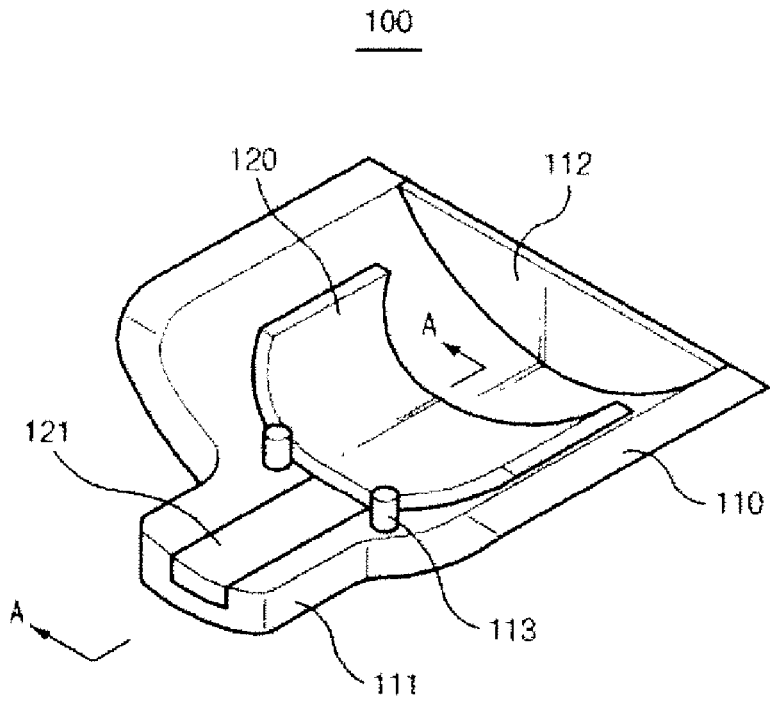
FIG. 4 is a perspective view of the artificial nail set of FIG. 3.
Figure 5:
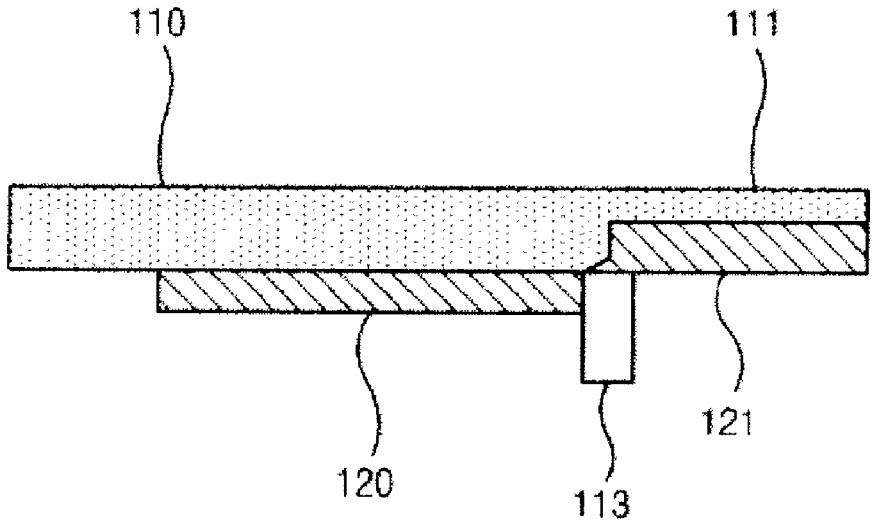
FIG. 5 is a cross-sectional view taken along line A-A of FIG. 4.
Figure 6A:
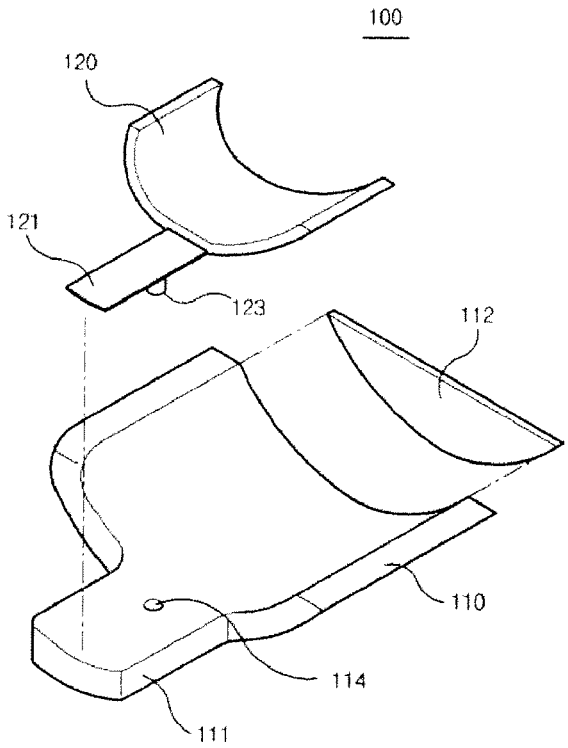
FIGS. 6*a* and 6*b* are exploded perspective views illustrating artificial nail sets according to exemplary embodiments of the present invention.
Figure 6B:
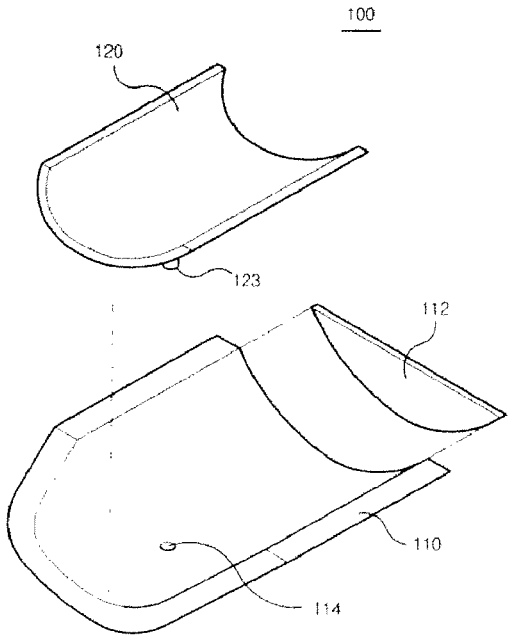

FIG. 3 is an exploded perspective view of an artificial nail set according to an exemplary embodiment of the present invention, FIG. 4 is a perspective view of the artificial nail set of FIG. 3, FIG. 5 is a cross-sectional view taken along line A-A of FIG. 4, and FIGS. 6*a* and 6*b* are exploded perspective views illustrating artificial nail sets according to exemplary embodiments of the present invention.

As illustrated in FIG. 3, the artificial nail set 100 includes an auxiliary member 110 and an artificial nail 120. A protective film 112 may be formed on the inner surface of the auxiliary member 110 to protect the artificial nail 120 from damage.

As illustrated in FIG. 4, the auxiliary member 110 not adherent to the artificial nail 120 surrounds the outer surface of the artificial nail 120 having a small thickness to protect the artificial nail 120 from damage. That is, the auxiliary member 110 acts as a protective film for the artificial nail 120. This constitution permits the transportation of the artificial nail set 100 without giving any damage to the original shape of the artificial nail 120. Examples of the artificial nail 120 include typical nails like full cover nails and tip nails that are used in the art.

The expression 'the auxiliary member 110 is not adherent to the artificial nail 120' as used herein means that the auxiliary member 110 is in close contact with but not bonded to the artificial nail 120, as illustrated in FIG. 5. That is, the auxiliary member 110 is separable from the artificial nail 120. The expression 'the auxiliary member 110 surrounds the outer surface of the artificial nail 120' means that the auxiliary member 110 having a larger size surrounds the outer surface of the artificial nail 120 having a smaller size to protect the artificial nail 120 from damage.

The auxiliary member 110 may have a coupling portion 111 at one side thereof and the artificial nail 120 may have a connecting part 121 at one side thereof. So long as the connecting part 121 is connected to the artificial nail 120 and is coupled to the coupling portion 111, the connecting part 121 does not require any particular shape. Preferably, the connecting part 121 is in the shape of a bar.

The coupling portion 111 is adapted to couple to the connecting part 121. The coupling portion 111 may have a groove into which the connecting part 121 is fitted, as illustrated in FIG. 3. Further, the coupling portion 111 may have an insertion recess 114 formed on the inner surface thereof and the connecting part 121 may have a protrusion 123 on the outer surface thereof, as illustrated in FIG. 6*a*. In the latter case, the protrusion 123 is fitted into the insertion recess 114 to couple the connecting part 121 to the coupling portion 111.

As illustrated in FIG. 6*b*, the artificial nail 120 may have a protrusion 123 formed on the outer surface of the artificial nail 120 and the auxiliary member 110 may have an insertion recess 114, whose shape corresponds to the shape of the protrusion 123, formed on the inner surface of the auxiliary member 120, thus avoiding the need to form the connection portion 121 and the coupling portion 111 illustrated in FIGS. 3 and 6*a*. The protrusion 123 can be fitted into the insertion recess 114 to couple the artificial nail 120 to the auxiliary member 110.

In the case where a tip nail or a wrap nail as the artificial nail 120 is attached to the end portion of a user's nail, it is difficult for the user to see where the distal end of the user's nail is. To overcome this difficulty, the artificial nail set 100 includes stoppers 113 protruding from the inner surface of the auxiliary member 110 to allow a user to easily see the distal end of the user's nail. Specifically, the stoppers 113 are formed in positions of the auxiliary member 110 where the coupling portion 111 is formed. That is, the stoppers 113 are formed on the inner surface of the auxiliary member 110 surrounding the outer surface of the artificial nail 120.

The auxiliary member 110 may be made of any suitable material that is not adherent to glue applied to the artificial nail 120 and is not chemically bonded to the artificial nail 120 during double injection molding. Preferably, the auxiliary member 110 is made of a material selected from polyethylene, polypropylene, polyurethane, polyamide, and polyacetal (polyoxymethylene (POM)). The artificial nail 120 may be made of any material that is commonly used in the art. Acrylonitrile butadiene styrene (ABS) is preferred as a material for the artificial nail 120.

The auxiliary member 110 may be transparent or slightly opaque so that the user can visually see the physical states (e.g., size, shape, color and preservation) of the artificial nail 120.

The auxiliary member 110 may have a circular arc shape. Specifically, the side of the auxiliary member 110 at which the coupling portion 111 is formed and the opposite side thereof are convex upward with the same curvature.

The artificial nail 120 may also have a circular arc shape. Specifically, the side of the artificial nail 120 at which the connecting part 121 is formed and the opposite side thereof are convex upward with the same curvature. The coupling portion 111 may also have a circular arc shape so as to be convex upward with the same curvature as the auxiliary member 110. Alternatively, the coupling portion 111 may be flat.

Both sides of the auxiliary member 110 in the shape of a circular arc have uniform thicknesses. With these dimensions, a force is uniformly distributed throughout the auxiliary member 110. Particularly, the force is strongly applied to both sides of the auxiliary member 110 to allow a user to easily attach the artificial nail 120 to the user's nail and to prevent both sides of the artificial nail 120 from being detached from both sides of the user's nail.

Although the auxiliary member 110 is not adherent to the artificial nail 120, the coupling between the coupling portion 111 of the auxiliary member 110 and the connecting part 121 of the artificial nail 120 allows the auxiliary member 110 to surround the outer surface of the artificial nail 120 and prevents the artificial nail 120 from escaping from the auxiliary member 110.

The artificial nail 120 is attached to a user's nail in accordance with the following procedure. First, the artificial nail 120 positioned on the inner surface of the auxiliary member 110 is attached to the user's nail. Then, the connecting portion between the artificial nail 120 and the connecting part 121 is cut by using a suitable cutting tool, such as scissors or a nail clipper. The connecting part 121 may be forcibly twisted by hand. As a result of the cutting or twisting, the artificial nail 120 and the auxiliary member 110 are easily separated from each other, leaving only the artificial nail 120 on the user's nail.

In the case of the artificial nail set 100 in which the artificial nail 120 is directly coupled to the auxiliary member 110 without the connecting part 121, after the artificial nail 120 positioned on the inner surface of the auxiliary member 110 is attached to a user's nail, a portion of the protrusion 123 is cut by using a suitable cutting tool, such as scissors or a nail clipper, to attach only the artificial nail 120 to the user's nail.

Figure 7:
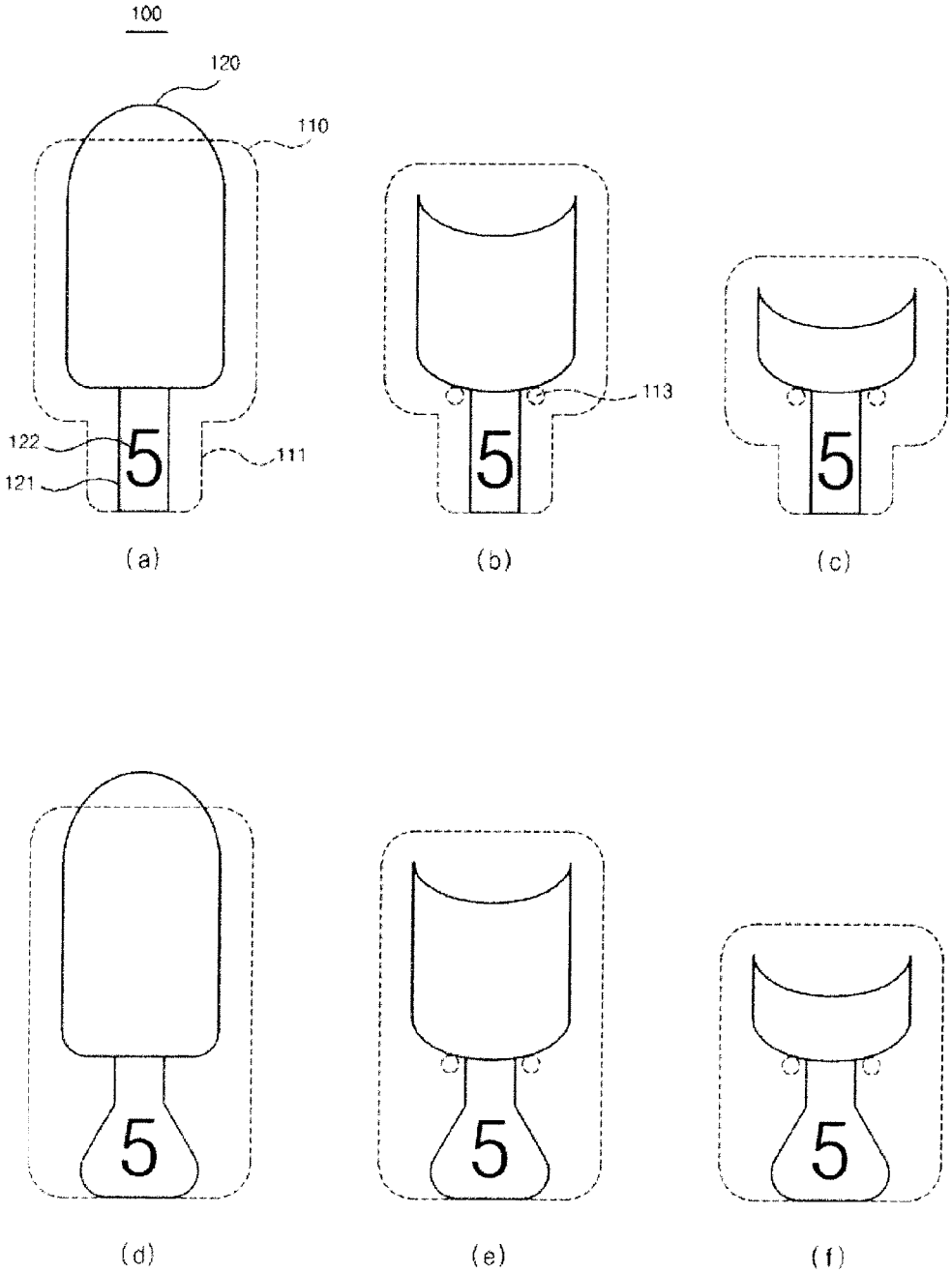
FIG. 7 illustrates plan views of several modifications of the artificial nail set of FIG. 3.

FIG. 7 illustrates plan views of several modifications of the artificial nail set 100.

As illustrated in FIG. 7, the shape of the artificial nail set 100 is not particularly limited so long as the auxiliary member 110 surrounds the outer surface of the artificial nail 120. The shape of the artificial nail set 100 may be slightly varied depending on the kind of the artificial nail 120 or the shape of the coupling portion 111.

The modified artificial nail sets 100 of FIGS. 7*a* (7*d*), 7*b* (7*e*) and 7*c* (7*f*) use full cover nails, long tip nails and short tip nails as artificial nails, respectively. The artificial nail sets 100 of FIGS. 7*a* and 7*d* use no protective film 112, unlike the other artificial nail sets. Stoppers 113 are provided in the artificial nail sets 100 of FIGS. 7*b*, 7*c*, 7*e* and 7*f* to assist users in seeing the distal ends of their nails more easily.

Each of the artificial nails 120 may have a connecting part 121 in the form of a bar at one side thereof, as illustrated in FIGS. 7*a*, 7*b* and 7*c*.

The shape of the auxiliary members 110 is not essentially limited. The auxiliary members 110 may have a partially rectangular shape, as illustrated in FIGS. 7*a*, 7*b* and 7*c*, or a substantially rectangular shape, as illustrated in FIGS. 7*d*, 7*e* and 7*f*.

The artificial nails 120 can be made in different sizes. A size label 22 may be attached to each of the coupling portions 111 and the connecting parts 121 to display the size of the artificial nail 120, so that a user can choose a suitable size of the artificial nail 120 in view of the size of the user's nail.

Hereinafter, methods for manufacturing the artificial nail set 100 of FIG. 3 or 6*a* will be explained.

Single injection molding and double injection molding are suitable processes for the manufacture of the artificial nail set 100. According to the single molding process, the auxiliary member 110 and the artificial nail 120 are produced separately and are coupled to each other. Specifically, the method of the present invention based on the single injection molding process includes producing a transparent or opaque auxiliary member 110 having a coupling portion 111 formed at one side thereof by injection molding, producing an artificial nail 120 having a connecting part 121 formed at one side thereof by injection molding, and coupling to the connecting part 121 of the artificial nail 120 to the coupling portion 111 of the auxiliary member 110 to allow the auxiliary member 110 to surround the outer surface of the artificial nail 120.

The auxiliary member 110 and the artificial nail 120 may be produced simultaneously by double injection molding. Specifically, the method of the present invention based on the double injection molding process includes producing an artificial nail 120 having a connecting part 121 formed at one side thereof and a transparent or opaque auxiliary member 110 having a coupling portion 111 formed at one side thereof simultaneously by injection molding such that the auxiliary member 110 surrounds the outer surface of the artificial nail 120.

The coupling portion 111 of the auxiliary member and the connecting part 121 of the artificial nail are not bonded to each other, but can be physically coupled to each other. The auxiliary member 110 and the artificial nail 120 may be coupled to each other in various ways, depending on the shape of the connecting part 121. Specifically, the connecting part 121 may be fitted into the groove of the coupling portion 111 (FIG. 3) or the connecting part 121 may be coupled to the coupling portion 111 by fitting the protrusion 123 of the connecting part 121 into the insertion recess 114, whose shape corresponds to the shape of the protrusion 123, of the coupling portion 111 (FIG. 6*a*).

Alternatively, as illustrated in FIG. 6*b*, the protrusion 123 formed on the outer surface of the artificial nail 120 can be fitted into the insertion recess 114, whose shape corresponds to the shape of the protrusion 123, formed on the inner surface of the auxiliary member 110 to directly couple the artificial nail 120 to the auxiliary member 110.

The auxiliary member 110 is not bonded to the artificial nail 120 because the auxiliary member 110 and the artificial nail 120 are made of different materials not adherent to each other. In the foregoing embodiments, the connecting part 121 of the artificial nail 120 may be coupled to the coupling portion 111 of the auxiliary member 110 to couple the artificial nail 120 to the auxiliary member 110, or the artificial nail 120 may be directly coupled to the auxiliary member 110. This coupling structure prevents the artificial nail 120 from escaping from the auxiliary member 120 during transport of the artificial nail set 110.

Any connecting structure may be adopted to connect the artificial nail 120 and the auxiliary member 110 without limitation so long as the artificial nail 120 does not escape from the auxiliary member 110.

As is apparent from the above description, the artificial nail sets and the methods according to the present invention have the following advantageous effects.

First, the use of the auxiliary member can protect the thin artificial nail from damage during transport or by a shock while maintaining the natural shape of the artificial nail.

Further, the auxiliary member is made of a transparent or slightly opaque material so that a user can visually see the physical states (e.g., size, shape, color and preservation) of the artificial nail.

Further, the artificial nail can be made in different sizes and its size can displayed to allow a user to choose a suitable size of the artificial nail in view of the size of the user's nail.

Further, a force applied to the lateral sides of the auxiliary member can prevent the lateral sides of the artificial nail from being detached from a user's nail.

The artificial nail, to which glue is applied, can be easily attached to a user's nail without leaving impurities thereon. In contrast, according to the prior art, a beauty artist attaches an artificial nail, to which glue is applied, to a user's nail without using any instrument, leaving impurities, such as fingerprints of the artist, on the artificial nail.

Further, the stoppers allow a user to easily see the distal end of the user's nail, so that the user can accurately position the artificial nail at the distal end of the user's nail.

The artificial nail sets of the present invention are applicable to all kinds of nails, particularly, are useful in attaching artificial nails to the end portions of natural nails.

Although the present invention has been described herein with reference to its exemplary embodiments, those skilled in the art will appreciate that various modifications and variations are possible without departing from the spirit and scope of the present invention as set forth in the appended claims.

What is claimed is:

1. An artificial nail set comprising an artificial nail having a connecting part formed at one side thereof, and an auxiliary member having a coupling portion formed at one side thereof, wherein the auxiliary member covers substantially all of a top surface of the artificial nail, and wherein the auxiliary member is not adherent to the artificial nail and the connecting part of the artificial nail is coupled to the coupling portion of the auxiliary member.

2. An artificial nail set comprising an artificial nail having a protrusion extending from a peripheral edge thereof, and an auxiliary member having an insertion recess on the inner surface thereof and surrounding an outer surface of the artificial nail, wherein the auxiliary member is not adherent to the artificial nail and the protrusion of the artificial nail is fitted into the insertion recess of the auxiliary member.

3. The artificial nail set of claim 1, wherein the auxiliary member has stoppers on an inner surface thereof.

4. The artificial nail set of claim 1 or 2, wherein the artificial nail has a circular arc shape with a substantially identical curvature on both sides thereof and wherein the auxiliary member has the same shape as the artificial nail.

5. The artificial nail set of claim 1 or 2, wherein the auxiliary member is transparent or opaque.

6. The artificial nail set of claim 1 or 2, wherein the auxiliary member is made of a material selected from polyethylene, polypropylene, polyurethane, polyamide, and polyacetal (polyoxymethylene (POM)).

* * * * *